US010724800B2

(12) United States Patent
Emrich et al.

(10) Patent No.: US 10,724,800 B2
(45) Date of Patent: Jul. 28, 2020

(54) EXHAUST GAS HEAT EXCHANGER WITH LATCHING CONTOURS

(71) Applicant: Mahle International GmbH, Stuttgart (DE)

(72) Inventors: Karsten Emrich, Stuttgart (DE); Vahid Havaldar, Stuttgart (DE); Bernd Kraemer, Schwieberdingen (DE); Gaelle Schmidgall, Stuttgart (DE)

(73) Assignee: MAHLE INTERNATIONAL GMBH (DE)

( * ) Notice: Subject to any disclaimer, the term of this patent is extended or adjusted under 35 U.S.C. 154(b) by 195 days.

(21) Appl. No.: 15/406,659

(22) Filed: Jan. 13, 2017

(65) Prior Publication Data

US 2017/0205148 A1 Jul. 20, 2017

(30) Foreign Application Priority Data

Jan. 15, 2016 (DE) ..... 10 2016 200 456

(51) Int. Cl.
*F28F 9/02* (2006.01)
*F28D 7/16* (2006.01)
(Continued)

(52) U.S. Cl.
CPC ..... *F28D 7/1653* (2013.01); *F01N 5/02* (2013.01); *F28D 7/1684* (2013.01);
(Continued)

(58) Field of Classification Search
CPC ..... F28D 7/1653; F28D 7/1684; F28D 7/02; F28D 21/0003; F28D 2021/0026;
(Continued)

(56) References Cited

U.S. PATENT DOCUMENTS 5,311,933 A * 5/1994 Lee ..... F28F 9/0226 165/149
7,278,473 B2 10/2007 Brunner et al.
(Continued)

FOREIGN PATENT DOCUMENTS

DE 9015085 U1 * 12/1991 ..... B29C 65/7855
DE 10228246 A1 1/2004
(Continued)

OTHER PUBLICATIONS

English equivalent for DE-102008019320.
English abstract for EP-1995544.
European Search Report dated Jun. 14, 2017.

*Primary Examiner* — Travis C Ruby
(74) *Attorney, Agent, or Firm* — Fishman Stewart PLLC

(57) ABSTRACT

An exhaust gas heat exchanger may include a housing and a heat exchanger block arranged therein, the heat exchanger block including tube plates and a tube bundle having a plurality of flat tubes held at longitudinal ends of the flat tubes in rim holes formed in a complementary manner thereto in the tube plates. A first flow path for exhaust gas may extend in the flat tubes, and a second flow path for coolant may extend around the flat tubes and within the housing. The housing may include a plurality of latching contours, which interact with a plurality of counterpart latching contours arranged on an associated tube plate to fix the tube plates and the heat exchanger block on the housing.

15 Claims, 2 Drawing Sheets

(51) Int. Cl.

| | |
|---|---|
| ***F28D 21/00*** | (2006.01) |
| ***F01N 5/02*** | (2006.01) |
| ***F28F 7/02*** | (2006.01) |
| ***F28F 9/18*** | (2006.01) |

(52) U.S. Cl.
CPC ..... *F28D 21/0003* (2013.01); *F28F 7/02* (2013.01); *F28F 9/02* (2013.01); *F28F 9/0229* (2013.01); *F28F 9/18* (2013.01); *F28D 2021/0026* (2013.01); *F28F 2275/08* (2013.01); *F28F 2280/00* (2013.01)

(58) Field of Classification Search
CPC .... F28F 9/02; F28F 9/0229; F28F 9/18; F28F 9/0224; F28F 9/182; F28F 9/185; F28F 21/08; F28F 2275/08; F28F 2280/00; F01N 5/02
See application file for complete search history.

(56) References Cited

U.S. PATENT DOCUMENTS

| | | | | |
|---|---|---|---|---|
| 9,097,466 | B2 | 8/2015 | Braic et al. | |
| 2008/0289833 | A1 | 11/2008 | Schienemann et al. | |
| 2012/0061053 | A1 | 3/2012 | Geskes et al. | |
| 2014/0014077 | A1 | 1/2014 | Schuricht et al. | |
| 2015/0292819 | A1* | 10/2015 | Woollen ..... | F28F 9/001 165/157 |

FOREIGN PATENT DOCUMENTS

| | | | |
|---|---|---|---|
| DE | 102008019320 | A1 | 10/2009 |
| DE | 102009012024 | A1 | 9/2010 |
| EP | 1995544 | A2 | 11/2008 |
| EP | 3012570 | A1 | 4/2016 |
| WO | WO-2012/019912 | A1 | 2/2012 |
| WO | WO-2012/085008 | A1 | 6/2012 |
| WO | WO-2014/154678 | A1 | 10/2014 |
| WO | WO-2014/173909 | A1 | 10/2014 |

* cited by examiner

EXHAUST GAS HEAT EXCHANGER WITH LATCHING CONTOURS

CROSS-REFERENCE TO RELATED APPLICATIONS

This application claims priorly to German Patent Application No. DE 10 2016 200 456.5, filed on Jan. 15, 2016, the contents of which are hereby incorporated by reference in its entirety.

TECHNICAL FIELD

The present invention relates to an exhaust gas heat exchanger having a housing and a heat exchanger block arranged therein. The invention also relates to a method for producing such a heat exchanger.

BACKGROUND

Exhaust gas heat exchangers of the generic type are well known and, to produce a sealed connection, are usually soldered in a soldering furnace and/or welded in a welding process. In order to be able to fix the individual components that are to be soldered or welded together relative to one another during the soldering process or welding process, what are referred to as soldering frames or soldering stands or corresponding welding stands or welding frames are usually used.

DE 10 2008 019 320 A1 discloses an exhaust gas heat exchanger having a heat exchanger block with a first axial termination device and with a second axial termination device, in which the heat exchanger block has both axial inlet openings and axial outlet openings and in which means for forming a form fit with the axial termination device are arranged on the heat exchanger block. The means for forming the form fit in that case protrude axially at least in part beyond the axial inlet openings and/or beyond the axial outlet openings of the heat exchanger block such that they are able to be arranged radially next to bearing shoulders of the axial termination devices, with the result that a particularly radially pressure-tight heat exchanger can be provided.

WO 2012/019912 A1 discloses a method for producing an exhaust gas heat exchanger for a motor vehicle, in which a tube bundle that receives exhaust gas of the motor vehicle is fastened in a prefabricated housing and is subsequently soldered to the housing. In order in that case to be able to dispense with an expensive soldering stand, the housing is elastically deformed by an extensively acting force, wherein the tube bundle is introduced into the housing while the force is being applied and, after the tube bundle has been positioned in the housing, the latter is relieved of the force, with the result that the tube bundle is braced inside the housing.

As already mentioned above, in order to solder/weld an exhaust gas heat exchanger, what are referred to as soldering stands/soldering frames or welding stands/welding frames have previously been used, but these require not inconsiderable assembly effort and cleaning effort. Furthermore, the assembly also increases the cycle time, with the result that the production costs of such an exhaust gas heat exchanger are increased.

SUMMARY

The present invention therefore deals with the problem of specifying an improved or at least an alternative embodiment for an exhaust gas heat exchanger of the generic type, which is distinguished in particular by simplified and additionally high quality production.

This problem is solved according to the invention by the subject matter of the independent claims. Advantageous embodiments are the subject matter of the dependent claims.

The present invention is based on the general idea of fixing individual components of an exhaust gas heat exchanger together via self-fixing connecting means, namely latching means, and as a result not having to hold these individual components in a welding frame/soldering frame in a complicated manner during a subsequent welding and/or soldering process. The exhaust gas heat exchanger according to the invention has in this case a housing and a heat exchanger block, arranged therein, which comprises a tube bundle having a plurality of flat tubes, wherein the flat tubes are held at their longitudinal ends in rim holes, formed in a complementary manner thereto, in tube plates. In this case, a first flow path for exhaust gas extends in the flat tubes, while a second flow path for coolant extends around the flat tubes and within the housing. According to the invention, latching contours are now provided on the housing, which interact with counterpart latching contours arranged on an associated tube plate and fix the two tube plates and thus the heat exchanger block on the housing. Thus, by way of the latching contours and the associated counterpart latching contours, it is possible to prefabricate and also fix the tube plates and thus also the flat tubes on the housing of the exhaust gas heat exchanger, with the result that an exhaust gas heat exchanger pre-fixed in such a way can be fed to a downstream sealing process, for example soldering or welding, without the previously necessary soldering stands or welding frames. With these latching contours and the associated counterpart latching contours, assembly effort is additionally also reduced, since in particular the complicated attachment of the previously necessary soldering frames/welding frames is now dispensed with. Such latched connections additionally ensure that the individual components are held reliably together during the subsequent connecting process and can furthermore be concluded in an automated manner, such that for example the latching of the tube plates to the housing can take place in an automated and thus cost-effective manner in an associated machine. As a result of the tube plates being latched to the associated housing, it is also possible to control the phenomenon of welding distortions, which was manageable only with difficulty with previous welding frames.

In an advantageous development of the solution according to the invention, the latching contours are in the form of latching lugs. Such latching lugs or latching hooks form a particularly simple embodiment of the latching contours and allow latching with counterpart latching contours that are likewise designed in an extremely simple manner, wherein such counterpart latching contours can be formed for example by an outer rim on the tube plate. In this case, it is clear that the counterpart latching contours do not have to be channels, depressions or the like, but can also be formed by a simple planar region of the tube plate, for example a planar rim region. Alternatively, such counterpart latching contours can also be configured as a recess or through-opening, wherein, in this case, the latching contour or the latching lug is latched to the rim of the through-opening.

In a further advantageous embodiment of the solution according to the invention, the housing and the tube plates are formed from metal, for example from aluminium. Aluminium has in this case the great advantage that it is firstly lightweight, affording great advantages, in particular with regard to fuel consumption, in particular for the use of such an exhaust gas heat exchanger in a motor vehicle. Secondly, aluminium has a comparatively high thermal conductivity, with the result that a high performance level of the exhaust gas heat exchanger can be achieved.

In a further advantageous embodiment of the solution according to the invention, the latching contours are arranged at least partially circumferentially at the rim of the housing such that the associated tube plate is clamped in place in between. The latching contours thus fix the associated tube plate not only in the axial direction, that is to say orthogonally to its plane on the housing, but also in the plane direction, since they themselves represent boundaries in the plane direction for the tube plate. As a result, particularly reliable fixing of each tube plate on the housing can be achieved.

Expediently, the housing and the tube plates are soldered and/or welded together. Regardless of the subsequent sealing method, that is to say for example by welding or soldering, the latching contours allow reliable fixing of each tube plate on the housing during the sealing process, that is to say during the subsequent welding or soldering operation, without the complicated and expensive soldering frames/welding frames that have previously been known from the prior art and are difficult to handle being necessary for this purpose.

Expediently, the latching contours are formed in one piece with the housing. As a result of the latching contours being formed in one piece with the housing, in particular the assembly of the tube plates on the housing can be considerably simplified since the latching contours already have to be arranged on the housing and merely still have to be latched with the counterpart latching contours arranged on the tube plate by the tube plate being pressed onto the housing. Separate assembly of the latching contours on the housing is thus not necessary. As a result, the production costs are also reduced since the latching contours, provided they are formed in one piece with the housing, can be produced together with the latter, for example in a common pressure casting process.

The present invention is also based on the general idea of specifying a method for producing an above-described exhaust gas heat exchanger, in which first of all a metal housing, a plurality of flat tubes and two tube plates are provided. The flat tubes and the two tube plates in this case form the heat exchanger block of the exhaust gas heat exchanger. In this case, first of all a tube plate is fixed on the housing on one side of the housing via the housing-side latching contours, whereupon the flat tubes are introduced into the associated rim holes in the tube plate and are positioned in the housing. Then, the second tube plate on the opposite side of the housing is placed on the latter such that the flat tubes pass into the associated rim holes in the second tube plate, such that they are held both in the first and in the opposite second tube plate. As a result of the second tube plate being pressed onto the housing, the latching contours are latched together and the second tube plate is fixed on the housing. The exhaust gas heat exchanger prefabricated in such a way and fixed with regard to its individual parts is subsequently introduced into a soldering furnace and soldered therein, or welded in a subsequent welding process, with the result that in particular the flat tubes are connected in a sealed manner to the rim holes of each tube plate. As a result of the tube plates that are latched to the housing via the latching contours provided according to the invention, the previously necessary soldering frames/welding frames are dispensed with, thereby considerably simplifying the production process.

Further important features and advantages of the invention can be gathered from the dependent claims, from the drawings and from the associated description of the figures with reference to the drawings.

It goes without saying that the features mentioned above and those yet to be explained below are usable not only in the combination specified in each case but also in other combinations or on their own without departing from the scope of the present invention.

Preferred exemplary embodiments of the invention are illustrated in the drawings and described in more detail in the following description, wherein identical reference signs relate to identical or similar or functionally similar components.

BRIEF DESCRIPTION OF THE DRAWINGS

In the drawings, in each case schematically.

DETAILED DESCRIPTION

Figure 1:
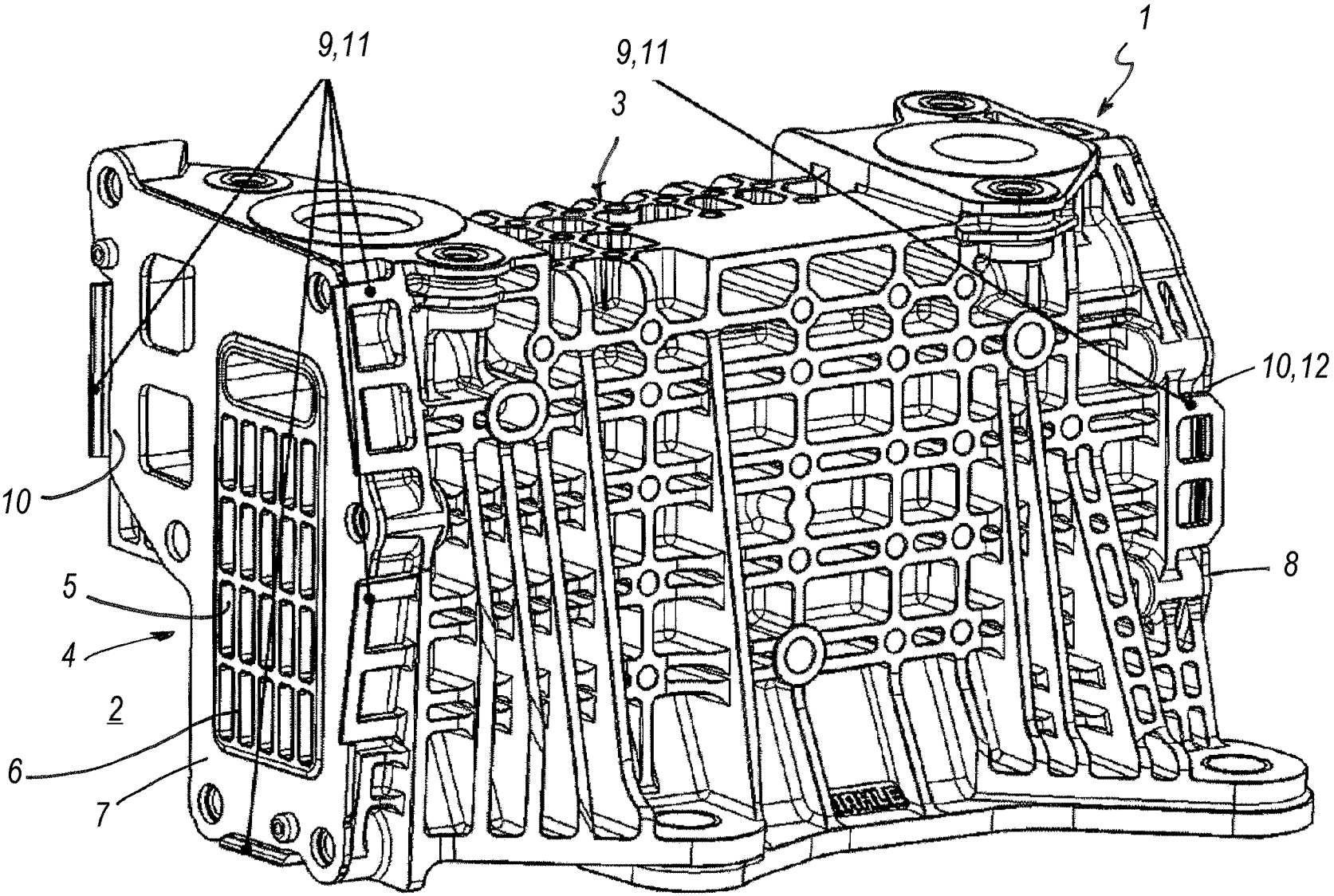
FIG. 1 shows a side view of an exhaust gas heat exchanger according to the invention.
Figure 2:
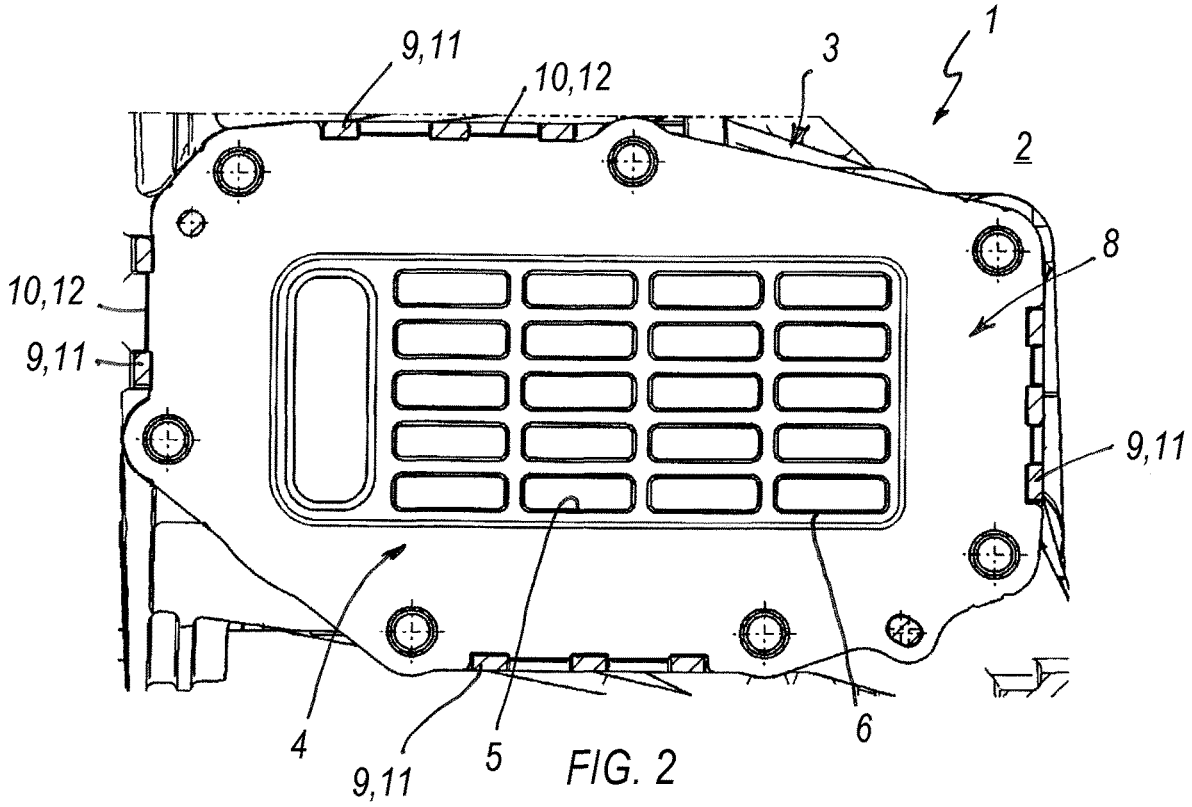
FIG. 2 shows a front view of the exhaust gas heat exchanger according to the invention with a tube plate.
Figure 3:
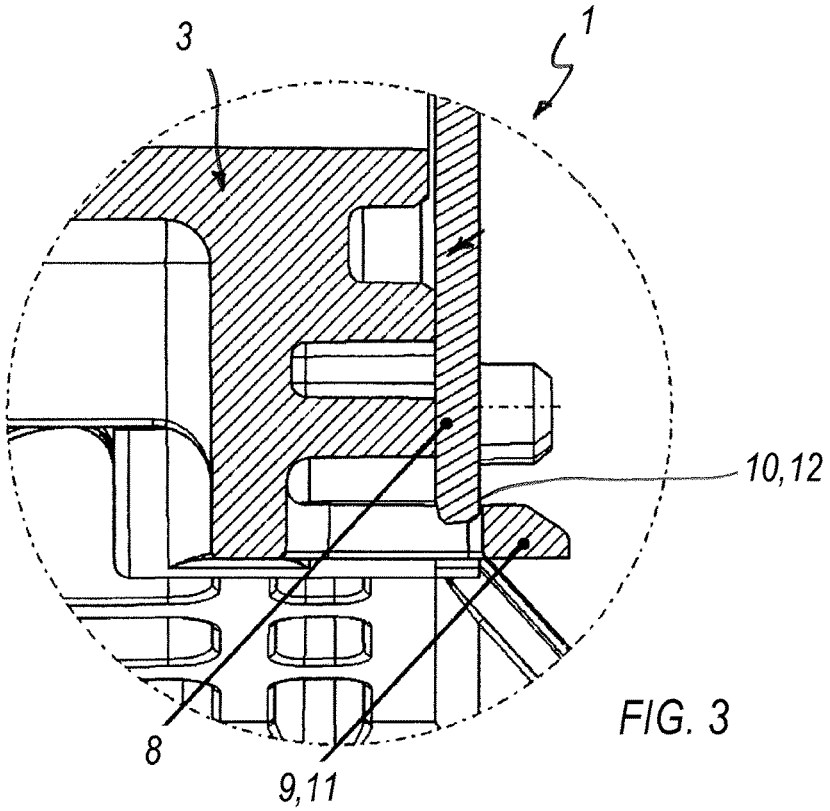
FIG. 3 shows a sectional illustration through a latched connection between the housing and tube plate of the exhaust gas heat exchanger.

According to FIGS. 1 to 3, an exhaust gas heat exchanger 1 according to the invention, which can be used for example in the region of an internal combustion engine 2 of a motor vehicle, has a housing 3 with a heat exchanger block 4 arranged therein. The heat exchanger block 4 has a tube bundle having a plurality of flat tubes 5 which are held at their longitudinal ends in rim holes 6, formed in a complementary manner thereto, in tube plates 7, 8. In this case, a first flow path for exhaust gas extends in the flat tubes 5 themselves, while a second flow path for coolant extends in a known manner around the flat tubes 5 and within the housing 3. According to the invention, in order to fix the tube plates 7 on the housing 3, latched connections are now provided, specifically latching contours 9 which interact with counterpart latching contours 10 arranged on an associated tube plate 7, 8 and thus fix the two tube plates 7, 8 and the heat exchanger block 4 on the housing 3.

On viewing the latching contours 9 according to FIGS. 1 to 3, it is possible to see that they are formed, in a particularly simply designed case, as latching lugs 11, while the counterpart latching contours 10 are formed as a recess or simply as an outer rim or rim 12 of the tube plate 7, 8. It is clear here that the counterpart latching contours 10 do not have to be channels, depressions or the like, but can also be formed by a simple planar region of the tube plate 7, 8, for example a planar rim region. Specifically, this means that the counterpart latching contour 10, for example the rim 12, can transition in a surface-flush manner into the otherwise planar tube plate 7, 8. In this case, the housing 3 and the tube plates 7, 8, just like the flat tubes 5, are formed from metal, for example from aluminium, wherein such a configuration made of aluminium not only has the advantage of it being possible to form the exhaust gas heat exchanger 1 easily but also has the advantage of achieving high heat transfer on account of the high thermal conductivity of aluminium. A sealed connection between the housing 3 and the tube plates 7, 8 or the flat tubes 5 and the tube plates 7, 8 can take place for example by soldering or welding.

In order to be able to fix the individual components, in particular the two tube plates 7, 8, immovably during the subsequent sealing process, that is to say for example the operation of welding or soldering to the housing 3, the latching contours 9 are provided according to the invention. Via such latching contours 9 and counterpart latching contours 10 arranged on the tube plates 7, 8, in particular the previously necessary welding frames or soldering frames, which were not only heavy and thus difficult to handle, but which also required a high cycle time and thus increased manufacturing or production costs, can be dispensed with entirely.

On viewing the latching contours 9 according to FIGS. 1 and 2, it is possible to see that they are arranged at least partially circumferentially at the rim of the housing 3, such that the associated tube plate 7, 8 is clamped in place in between. The individual latching contours 9, which are configured as latching hooks 11 in the present case, thus provide a stop in the plane direction of each tube plate 7, 8, and also orthogonally thereto.

In order to be able to produce the latching contours 9 cost-effectively, they can be formed in one piece with the housing 3, in particular produced in a common pressure casting operation. Of course, purely theoretically, a separate configuration of the individual latching contours 9, for example as clips, is also conceivable. Such clips could be dispensed with entirely after the welding/soldering process, but require increased assembly effort.

The exhaust gas heat exchanger 1 according to the invention is produced as follows: first of all, the metal housing 3, a plurality of flat tubes 5 and two tube plates 7, 8 are provided, wherein a first tube plate 7 is fixed on the housing 3 on one side of the housing 3 via the housing-side latching contours 9. Subsequently, the flat tubes 5 are introduced into the associated rim holes 6 in the tube plate 7 and are positioned in the housing 3. Next, the second tube plate 8 on the opposite side is placed on the housing 3 such that the flat tubes 5 pass into the associated rim holes 6 in the second tube plate 8 and are held thereby. Subsequently, the second tube plate 8 is pressed against the housing 3 until the latching contours 9 engage behind the counterpart latching contours 10 on the second tube plate 8 and thus fix the tube plate 8 on the housing 3. In this now preassembled state, the subsequent sealing process, i.e. soldering in a soldering furnace or welding, can take place.

By means of the latching contours 9 according to the invention and the associated counterpart latching contours 10, the individual components 7, 8 can be pre-fixed easily to the housing 3, and at the same time fixing during a subsequent soldering/welding process can be achieved without previously necessary soldering frames/welding frames that are difficult to handle and expensive being necessary for this purpose.

The invention claimed is:

1. An exhaust gas heat exchanger comprising:

a housing and a heat exchanger block arranged therein, the heat exchanger block including tube plates and a tube bundle having a plurality of flat tubes held at longitudinal ends of the flat tubes in rim holes formed in a complementary manner thereto in the tube plates;

wherein a first flow path for exhaust gas extends in the plurality of flat tubes and a second flow path for coolant extends around the plurality of flat tubes and within the housing;

wherein a plurality of latching contours in the form of latching hooks are provided on the housing, the plurality of latching contours interacting with a plurality of counterpart latching contours each in the form of a rim along an external edge of an outer surface of an associated tube plate in which the rim holes are formed, each latching contour extending linearly from the housing to a distal end of the latching contour in a direction of the tubes to latch to the external edge in a direction transverse to the direction of the tubes such that the plurality of latching contours stops the associated tube plate from moving laterally and longitudinally to fix the tube plates and the heat exchanger block on the housing; and wherein at least one of the latching hooks includes a plurality of legs extending from the housing in the direction of the tubes and being spaced apart from each other, and a cross member at a distal end of the hook connecting the plurality of legs, the cross member including a latch portion that projects from the plurality of legs in a direction transverse to the direction of the tubes at the distal end of the hook to latch to the external edge via the latch portion.

2. The exhaust gas heat exchanger according to claim 1, wherein the housing and the tube plates are formed from metal.

3. The exhaust gas heat exchanger according to claim 1, wherein the housing and the tube plates are at least one of soldered and welded together.

4. The exhaust gas heat exchanger according to claim 3, wherein the housing and the tube plates are formed from metal.

5. The exhaust gas heat exchanger according to claim 1, wherein the plurality of latching contours are arranged at least partially circumferentially at a rim of the housing such that the associated tube plate is clamped in place in between.

6. The exhaust gas heat exchanger according to claim 5, wherein the housing and the tube plates are at least one of soldered and welded together.

7. The exhaust gas heat exchanger according to claim 1, wherein the plurality of latching contours are formed in one piece with the housing.

8. The exhaust gas heat exchanger according to claim 7, wherein the housing and the tube plates are at least one of soldered and welded together.

9. A method for producing an exhaust gas heat exchanger, comprising:

providing a housing having a plurality of latching contours in the form of latching hooks, a plurality of flat tubes and a first tube plate and a second tube plate, the first tube plate and the second tube plate each having a plurality of rim holes and a plurality of counterpart latching contours each in the form of a rim along an external edge of an outer surface of an associated tube plate in which the rim holes are formed, the plurality of counterpart latching contours arranged to interact with the plurality of latching contours of the housing, each latching contour extending linearly from the housing to a distal end of the latching contour;

fixing the first tube plate on one side of the housing via the plurality of latching contours and the plurality of counterpart latching contours of the first tube plate by latching a corresponding latching hook to the external edge of the first tube plate;

introducing the plurality of flat tubes into the plurality of rim holes in the first tube plate and positioning the plurality of flat tubes in the housing;

placing the second tube plate on an opposite side of the housing such that the plurality of flat tubes pass into the plurality of rim holes in the second tube plate;

pressing the second tube plate onto the housing until the plurality of latching contours latch together with the plurality of counterpart latching contours of the second tube plate and fix the second tube plate on the housing by latching a corresponding latching hook to the external edge of the second tube plate; and at least one of soldering and welding the first tube plate and the second tube plate to the housing;

wherein at least one of the latching hooks includes a plurality of legs extending from the housing in the direction of the tubes and being spaced apart from each other, and a cross member at a distal end of the hook connecting the plurality of legs, the cross member including a latch portion that projects from the plurality of legs in a direction transverse to the direction of the tubes at the distal end of the hook to latch to the external edge via the latch portion.

10. The method according to claim 9, wherein the housing and the tube plates are formed from metal.

11. The method according to claim 9, wherein the plurality of latching contours are arranged at least partially circumferentially at the rim of the housing such that the associated tube plate is clamped in place in between.

12. The method according to claim 9, wherein the plurality of latching contours are formed in one piece with the housing.

13. An exhaust gas heat exchanger comprising:

a housing formed from metal having a plurality of latching contours in the form of latching hooks arranged at least partially circumferentially at a rim of the housing, each latching contour extending linearly from the housing to a distal end of the latching contour;

a heat exchanger block having a plurality of flat tubes; and at least two tube plates formed from metal, each of the at least two tube plates having a plurality of rim holes and a plurality of counterpart latching contours each in the form of a rim along an external edge of an outer surface of an associated tube plate in which the rim holes are formed, the external edge being arranged to receive a corresponding latching hook thereon to fix the at least two tube plates and thus the heat exchanger block to the housing;

wherein the plurality of flat tubes are held at their longitudinal ends by the plurality of rim holes in the at least two tube plates;

wherein a first flow path for exhaust gas extends in the plurality of flat tubes and a second flow path for coolant extends around the plurality of flat tubes and within the housing; and wherein at least one of the latching hooks includes a plurality of legs extending from the housing in the direction of the tubes and being spaced apart from each other, and a cross member at a distal end of the hook connecting the plurality of legs, the cross member including a latch portion that projects from the plurality of legs in a direction transverse to the direction of the tubes at the distal end of the hook to latch to the external edge via the latch portion.

14. The exhaust gas heat exchanger according to claim 13, wherein the housing and the at least two tube plates are at least one of soldered and welded together.

15. The exhaust gas heat exchanger according to claim 13, wherein the plurality of latching contours are formed in one piece with the housing.

* * * * *